US005386996A

United States Patent [19]

Hiruta et al.

[11] Patent Number: 5,386,996

[45] Date of Patent: Feb. 7, 1995

[54] GOLF CLUB HEAD

[75] Inventors: Masaomi Hiruta, Tokyo; Ikuo Aoki, Chiba; Ryohei Uji, Tokyo; Hirato Shimasaki, Tokyo; Hiroshi Ezaki, Tokyo; Hideyuki Ishii, Tokyo; Hidekimi Inoue, Kanagawa, all of Japan

[73] Assignee: Bridgestone Sports Co., Ltd., Tokyo, Japan

[21] Appl. No.: 85,278

[22] Filed: Jun. 30, 1993

[30] Foreign Application Priority Data

Jul. 3, 1992 [JP] Japan ..... 4-200427

[51] Int. Cl.[6] ..... A63B 53/04

[52] U.S. Cl. ..... 273/174; 273/173; 273/167 A; 273/167 F

[58] Field of Search ..... 273/167 R, 173, 174, 273/167 A, 167 F, 167 J

[56] References Cited

U.S. PATENT DOCUMENTS 3,989,248 11/1976 Campau .
4,824,115 4/1989 Walther ..... 273/173 X
5,024,437 6/1991 Anderson ..... 273/173 X

FOREIGN PATENT DOCUMENTS 63-290590 11/1988 Japan .
3-228782 10/1991 Japan .
4-82575 3/1992 Japan .
4-256764 9/1992 Japan .

*Primary Examiner*—Mark S. Graham
*Assistant Examiner*—Raleigh W. Chiu
*Attorney, Agent, or Firm*—Jordan and Hamburg

[57] ABSTRACT

The present invention provides a golf club head made of at least a first and second head components formed integrally with each other. A metallic material of the first head component is different in kind from that of the second head component. At an anti-disjoining device such as a projection, concavity or the like is formed, as a part of the head, on all or a part of an end face of the first head component, which is to join the second head component. Further a metallic material having a melting point 200° C. or more below that of the metallic material of the first head component is cast to the first head component to integrally join the end faces of the first and second head components, thereby forming the second head component.

10 Claims, 5 Drawing Sheets

GOLF CLUB HEAD

BACKGROUND OF THE INVENTION

The present invention relates to a golf club head made of a combination of two or more different metallic materials.

To meet the requirements for increased flying distance of a ball hit with a golf club, feeling of ball hitting with the club, etc., various proposals have heretofore been made as to golf club heads made of two or more different metallic materials in combination, so-called hybrid metallic golf club heads. A typical one of such well-known metallic golf club heads is illustrated in FIG. 1. A golf club head shown in FIG. 1 is that of a so-called "wood" club. A face portion 100 of this club head is made of a titanium alloy while the rest 101 thereof is made of stainless steel. FIG. 2 shows the head of a so-called "iron" club. A face portion 200 of this iron club head is made of a titanium alloy while the rest 201 thereof is made of beryllium copper or stainless steel. Further, some wood club heads are also known of which a sole portion is made of kind of metal while the rest thereof is made of another kind. In such conventional golf club heads, the metallic materials of different kinds are joined to each other by screwing the face portion 100 (200) of the club head to the rest 101 (201) thereof, force fitting the face portion to the rest or bonding the face portion to the rest with an adhesive.

However, such conventional joining methods result in a shift of one joint boundary with respect to another, insufficient joining strength and thus poor durability. Further, taking the strength and durability of the golf club head into consideration leads to a limitation of the joining area. Thus, even if an optimum combination of different metallic materials is designed for a lower and deeper center of gravity, increased moment of inertia and improved feeling of ball hitting, the limitation of the joining area makes it difficult to manufacture a golf head exactly as designed.

SUMMARY OF THE INVENTION

Accordingly, the present invention has an object to provide a golf club head made of different materials meeting required performances, combined according to required characteristics and of which the center of gravity can be set in a lower and deeper position and also the moment of inertia can be increased.

The above object is accomplished by providing a golf club head made of at least a first and second head components formed integrally with each other, the metallic material of the first head component being different in kind from that of the second head component, wherein an anti-disjoining means such as a projection, concavity or the like is formed, as a part of the head, on all or a part of the end face of the first head component, which is to join the second head component, and a metallic material having a melting point 200° C. or more below that of the metallic material of the first head component is cast to the first head component to integrally join the end faces of the first and second head components, thereby forming the second head component.

In the golf club head according to the present invention, the first and second head components are joined to each other by casting a metallic material for the second component to the first head component, not by the conventional method such as screwing, force-fitting or bonding with adhesive. Therefore, the end faces of both the head components are rigidly joined to each other. The golf club head thus produced has a sufficient strength and durability. Also the integral joining of the first and second head components can be done easily and rapidly as compared with the conventional method such as screwing, bonding or the like. The joining area is little limited. By selecting an appropriate combination of different metallic materials, the center of gravity of the head can easily be set in an optimum position and the peripheral weight of the head can also easily be distributed. With such a golf club head, it is possible to hit the ball high over a longer distance with an improved directional stability.

DETAILED DESCRIPTION OF THE PREFERRED EMBODIMENTS

The present invention will be better understood from the ensuing description made, by way of example, of the preferred embodiments thereof with reference to the drawings.

Figure 3:
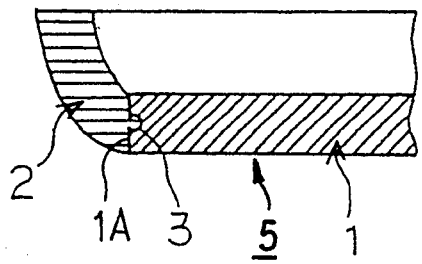
FIG. 3 is a sectional view of a lower half, essential part, of a wood club head according to the present invention.

FIG. 3 is a fragmentary sectional view, enlarged in scale, of a metal golf club head made of which a sole width is larger than a face height, namely, a wood club head. FIG. 3 shows the lower half 5 of the club head. The club head consists of a first head component 1 forming the club head sole and a second head component 2 forming the periphery of the first head component 1. As shown, the first head component 1 has an anti-disjoining means 3 formed on all or a part of an end face 1A thereof. The second head component 2 is made of a different metallic material having a melting point 200° C. or more below that of the metallic material of the first head component 1. The metallic material of the second head component 2 is cast to the first head component 1 so that the end faces of the first and second head components join each other. A beryllium copper, having a specific gravity of 8.5, is used to make the first head component 1, which forms the sole, while an aluminum alloy, having a specific gravity of 2.7, is used to form the second head component 2, so that the sole of the club head heavier. In any event, the difference between the specific gravity of the metallic material used to make the first head component and the metallic material used to make the second head component is greater than one. After the beryllium copper is cast in a mold to form the first head component 1, the aluminum alloy is cast to form the second head component 2, thereby forming the lower half 5 of the head as shown in FIG. 3.

Figure 4:
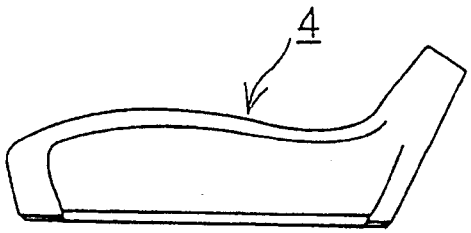
FIG. 4 is a front view of an upper half of a golf club head according to the present invention.
Figure 5:
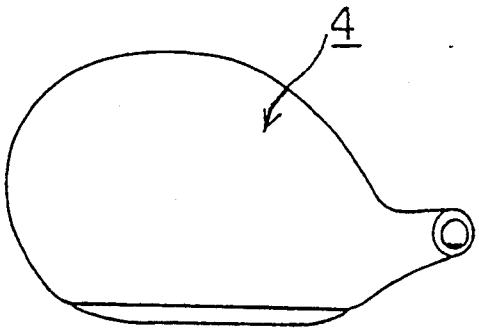
FIG. 5 is a top view of the upper half of the golf club head acording to the present invention.
Figure 6:
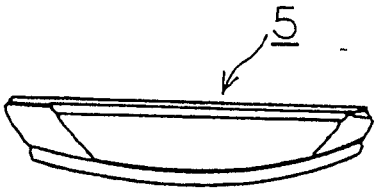
FIG. 6 is a front view of the lower half of the golf club head according to the present invention.
Figure 7:
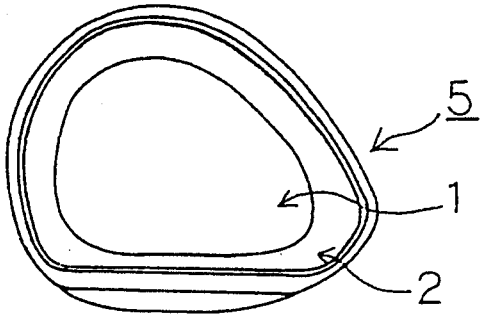
FIG. 7 is a top view of the lower half of the golf club head according to the present invention.
Figure 8:
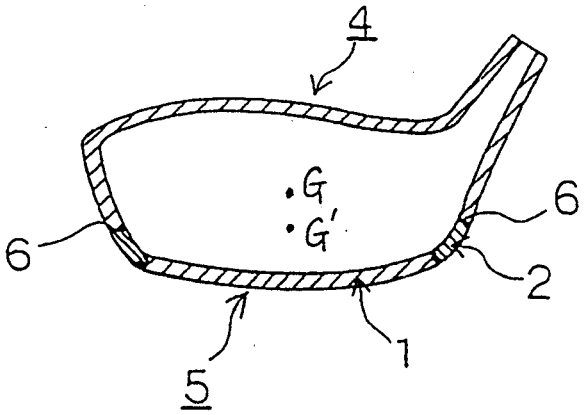
FIG. 8 is a sectional view of a golf club head assembled by welding the upper and lower halves of the golf club head according to the present invention.
Figure 9:
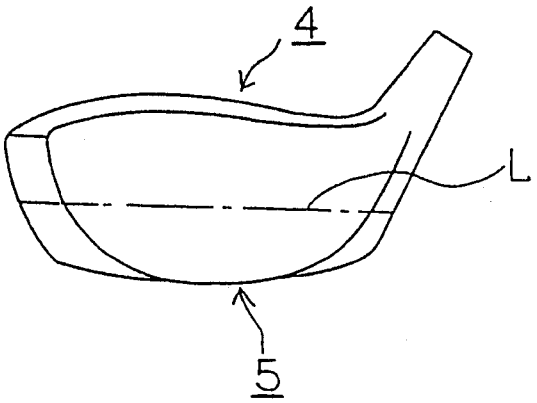
FIG. 9 is a front view of the assembled golf club head.

FIG. 4 shows an upper half 4 of the head. This upper half 4 is formed by casting an aluminum alloy, having a specific gravity of 2.7, similarly to the second head component 2. FIG. 5 is a top view of the upper half 4 of the head in FIG. 4. FIG. 3 shows a portion of the club head according to the present invention. This portion forms a part of the lower half 5 as shown in FIG. 6. The lower half 5 shown in FIG. 6 is an integration made by casting a metallic material for the first head component 1 and a different metallic material for the second head component 2 as shown in FIG. 7. The upper and lower halves 4 and 5, respectively, are welded to each other to define a club head as shown in FIG. 8. The reference numeral 6 in FIG. 8 denotes a welding. In FIG. 8, the symbol G refers to the center of gravity when an entire club head is made of stainless steel. The symbol G' denotes the center of gravity of the golf head according to the present invention. According to the present invention, the center of gravity is located about 5 mm lower than that in the stainless steel-made club head. FIG. 9 is a front view of the club head assembled by welding the upper and lower halves 4 and 5 to each other. The welding line is indicated with the symbol L. It should be noted that a crown or upper half 4 of this head should be made of a same material as that of the lower half 5 or second head component 2, since it is difficult to weld metallic materials of different kinds to each other.

Figure 10:
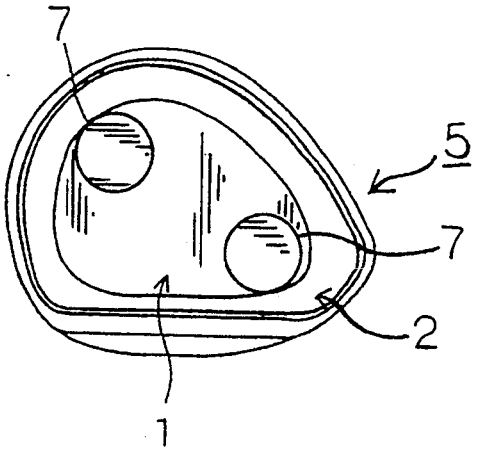
FIG. 10 is a top view of an example of the sole of the lower half made of two different metallic materials.

FIG. 10 shows another embodiment in which the first head component 1, as the club head sole, is made of two kinds of metallic materials, not of a single metallic material. In this embodiment, masses 7 of a different metallic material from that of the rest of the sole or first head component 1 and of which the specific gravity is larger than that of the beryllium copper (the material of the sole) are disposed in the sole at toe and heel sides, respectively, thereof. Such metallic masses 7, thus disposed diagonally at the toe and heel sides, respectively, will assure improved directional stability when hitting a ball.

In the embodiments described in the foregoing, a copper alloy and aluminum alloy are used in combination. However, the combination of different metallic materials is not limited to these embodiments, but any one may be selected from combinations of aluminum and stainless steel, aluminum and iron, titanium and iron, titanium and bronze, etc. Furthermore, two kinds of metallic materials may not only be used in combination but three or more kinds of metallic materials may also be used in combination. Note, however, that the metallic materials to be welded to each other should be of a same kind for ease of welding. The metallic material to first be cast into a predetermined form by the lost wax process should have a melting point 200° C. or more above that of the metallic material of which the end is integrally cast to the first metallic material. More particularly, since the copper alloy has a melting point 200° C. or more above that of the aluminum alloy, the sole portion of the club head is first produced from a copper alloy by the lost wax process. Thereafter, an aluminum alloy having a melting point 200° C. or more below the copper alloy is cast by the internal chill method in the lost wax process to form the periphery of the sole. The sole portion will not melt at the melting temperature of the aluminum alloy but only the aluminum alloy will melt and become integral with the anti-disjoining means 3 formed on the end face of the sole. In the embodiment shown in FIG. 10, the anti-disjoining means 3 is formed on the end face of the mass 7 of, for example, a different metallic material from that of the rest of the head sole and of which the melting point is 200° C. or more above the copper alloy, and the copper alloy is cast to the mass 7 of a different kind of metallic material.

The aforementioned embodiment is a golf club head of which the sole width is larger than the face height, a so-called wood club head. However, the present invention is not be limited to such a wood club head, but it is also applicable to an iron club head as will be described later. In the embodiment having been described in the foregoing, the sole portion of the golf club head is formed from the first head component 1, but at least the face portion thereof may be formed from the second head component 2.

Figure 11:
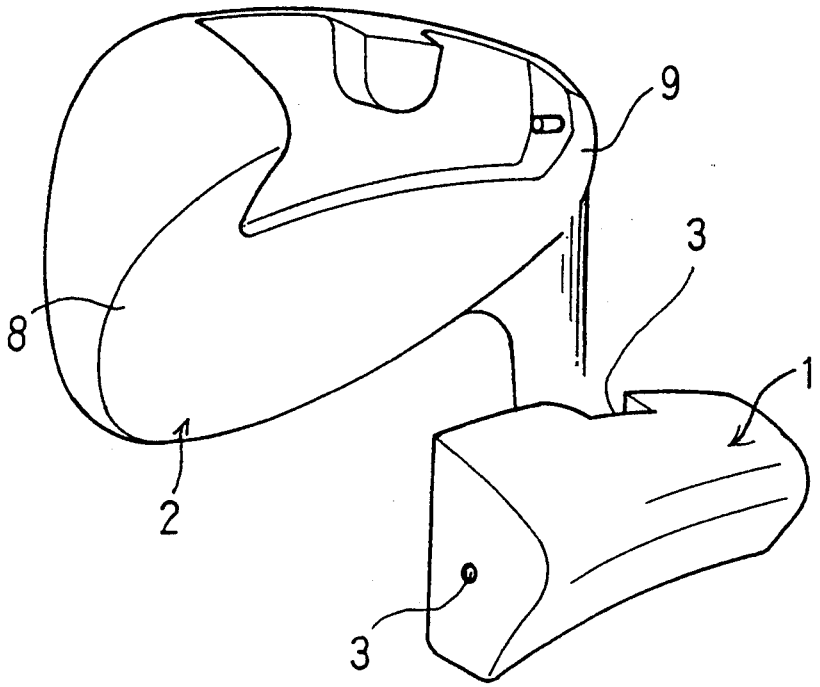
FIG. 11 is an exploded perspective view of an "iron" club head according to the present invention.

FIG. 11 shows an iron club head of which the sole portion is formed from the first head component 1 while the rest of the club head is formed from the second head component 2. For example, the first head component 1 is made of a beryllium copper and an anti-disjoining means 3 is formed in an appropriate position, and then the first head component 1 is set in the mold. Thereafter, a metallic material for the second head component 2, for example, an aluminum alloy, is cast into the mold in which the first head component 1 is already set as described above.

The iron club head thus manufactured and shown in FIG. 11 has a low and deep center of gravity.

By extending the first head component 1 made of a beryllium copper to a toe 8 and heel 9 of the golf club head shown in FIG. 11, the club head can have an increased moment of inertia.

Figure 1:
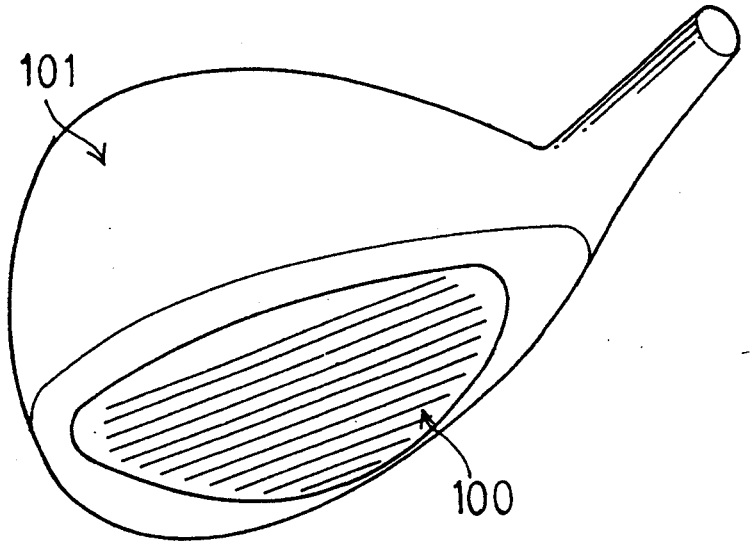
FIG.1 (PRIOR ART)
FIG. 1 is a perspective view of a head of a conventional "wood" club.
Figure 2:
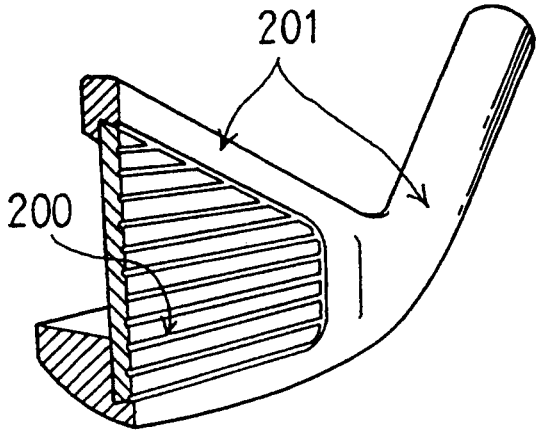
FIG.2 (PRIOR ART)
FIG. 2 is a partially fragmentary perspective view of a head of a conventional "iron" club.

Also in iron club heads, the face portion and the rest may be made from different kinds of metallic materials, respectively. For example, in the conventional club head shown in FIG. 2, a concavity as the anti-disjoining means 3 as shown in FIG. 11 is formed in all or part of the end face of the other portion 201 than the face portion, that is joined to the face portion 200, and a metallic material for the face portion 200 is cast to the other portion 201. In this case, the other portion 201 is the first head component 1 while the face portion 200 is the second head component 2.

What is claimed is:

1. A golf club head made of at least a first and second head components formed integrally with each other, wherein:

the club head is a wood club head and at least a sole portion thereof is made of the first head component;

a metallic material of the first head component being different in kind from that of the second head component;

an anti-disjoining means being formed as a part of the head, on all or a part of an end face of the first head component, which is to join the second head component; and a metallic material having a melting point 200° C. or more below that of the metallic material of the first head component being cast to the first head component to integrally join the end portions of the first and second head components, thereby forming the second head component.

2. A golf club head as set forth in claim 1, wherein the difference between the specific gravity of the metallic material for the first head component and the specific gravity of the metallic material for the second head component is greater than one.

3. A golf club head as set forth in claim 1, wherein the club head is a wood club head and at least a face portion thereof is made of the second head component.

4. A golf club head as set forth in claim 3, wherein the difference between the specific gravity of the metallic material for the first head component and the specific gravity of the metallic material for the second head component is greater than one.

5. A golf club head, according to claim 1, wherein said anti-disjoining means is selected from the group consisting of a projection and a concavity.

6. A golf club head made of at least a first and second head components formed integrally with each other, wherein:

the club head is an iron club head and at least a sole portion thereof is made of the first head component;

a metallic material of the first head component being different in kind from that of the second head component;

an anti-disjoining means being formed as a part of the head, on all or a part of an end face of the first head component, which is to join the second head component; and a metallic material having a melting point 200° C. or more below that of the metallic material of the first head component being cast to the first head component to integrally join the end portions of the first and second head components, thereby forming the second head component.

7. A golf club head as set forth in claim 6, wherein the difference between the specific gravity of the metallic material for the first head component and the specific gravity of the metallic material for the second head component is greater than one.

8. A golf club head as set forth in claim 6, wherein the club head is an iron club head and at least a face portion thereof is made of the second head component.

9. A golf club head as set forth in claim 8, wherein the difference between the specific gravity of the metallic material for the first head component and the specific gravity of the metallic material for the second head component is greater than one.

10. A golf club head, according to claim 6, wherein said anti-disjoining means is selected from the group consisting of a projection and a concavity.

* * * * *